US011027540B2

(12) United States Patent
Takagishi et al.

(10) Patent No.: US 11,027,540 B2
(45) Date of Patent: Jun. 8, 2021

(54) INKJET RECORDING DEVICE

(71) Applicant: Hitachi Industrial Equipment Systems Co., Ltd., Tokyo (JP)

(72) Inventors: Tsuneaki Takagishi, Tokyo (JP); Manabu Kato, Tokyo (JP); An Kyu, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/496,127

(22) PCT Filed: Mar. 12, 2018

(86) PCT No.: PCT/JP2018/009477
§ 371 (c)(1),
(2) Date: Sep. 20, 2019

(87) PCT Pub. No.: WO2018/186112
PCT Pub. Date: Oct. 11, 2018

(65) Prior Publication Data

US 2020/0094545 A1 Mar. 26, 2020

(30) Foreign Application Priority Data

Apr. 5, 2017 (JP) ..... JP2017-075295

(51) Int. Cl.
*B41J 2/025* (2006.01)
*B41J 2/085* (2006.01)
*B41J 2/13* (2006.01)

(52) U.S. Cl.
CPC ..... *B41J 2/025* (2013.01); *B41J 2/085* (2013.01); *B41J 2/13* (2013.01)

(58) Field of Classification Search
CPC ..... B41J 2/025; B41J 2/085; B41J 2/13; B41J 2/075
See application file for complete search history.

(56) References Cited

U.S. PATENT DOCUMENTS 4,338,613 A 7/1982 Cruz-Uribe
2001/0001244 A1 5/2001 Rhodes
(Continued)

FOREIGN PATENT DOCUMENTS

CN 1151941 A * 6/1997 ..... B41J 2/075
CN 1151941 A 6/1997
(Continued)

OTHER PUBLICATIONS

IP.com search (Year: 2020).*
(Continued)

*Primary Examiner* — Lisa Solomon
(74) *Attorney, Agent, or Firm* — Crowell & Moring LLP

(57) ABSTRACT

An object of the present invention is to provide an inkjet recording device capable of adjusting a clearance between prints formed by two nozzles (114, 115), and capable of printing a print content at a high speed. In order to achieve the object, there is provided an inkjet recording device which has two sub-print heads including nozzles (114, 115), charging electrodes (116, 117), deflection electrodes (118, 119), and gutters (120, 121), in which the two nozzles are disposed in a deflection direction of ink particles, and which performs printing on a printed object (124) while moving the printed object (124) relative to the ink particles in a direction substantially perpendicular to the deflection direction of the ink particles, the inkjet recording device having a function for reducing a clearance between print results (125, 126), printed by the two nozzles (114, 115), by controlling a voltage applied to the charging electrodes (116, 117) and a voltage applied to the deflection electrode (118, 119).

8 Claims, 4 Drawing Sheets

(56) References Cited

U.S. PATENT DOCUMENTS

| | | | |
|---|---|---|---|
| 2005/0122381 | A1 | 6/2005 | Golombat et al. |
| 2007/0211098 | A1 | 9/2007 | Pechtl |
| 2016/0325545 | A1 | 11/2016 | Kurihara et al. |
| 2018/0086052 | A1 | 3/2018 | Kurihara et al. |

FOREIGN PATENT DOCUMENTS

| | | | | | |
|---|---|---|---|---|---|
| CN | 1302259 | A | | 7/2001 | |
| EP | 0 755 790 | A1 | | 1/1997 | |
| JP | 57-8164 | A | | 1/1982 | |
| JP | 57-59777 | A | | 4/1982 | |
| JP | 6-262766 | A | | 9/1994 | |
| JP | 2005-515918 | A | | 6/2005 | |
| JP | 2010-137528 | A | | 6/2010 | |
| JP | 2010137528 | A | * | 6/2010 | |
| JP | 2010-228402 | A | | 10/2010 | |
| JP | 2015-13385 | A | | 1/2015 | |
| JP | 2015-128869 | A | | 7/2015 | |
| JP | 2016-198941 | A | | 12/2016 | |
| JP | 2016198941 | A | * | 12/2016 | ..... B41J 29/38 |

OTHER PUBLICATIONS

Machine Translation JP2010137528, Moriai, Takuya et al., Jun. 24, 2010, Paragraphs 0021-0038 (Year: 2010).*
Machine Translation CN1151941, Wassink, Michel Harjon et al., Jun. 18, 1997, Paragraph 0005 (Year: 1997).*
Machine Translation JP2016198941, Kurihara, Hiroko et al., Dec. 1, 2016, Paragraph 0026 (Year: 2016).*
IP.com search (Year: 2021).*
International Search Report (PCT/ISA/210) issued in PCT Application No. PCT/JP2018/009477 dated Apr. 24, 2018 with English translation (four (4) pages).
Japanese-language Written Opinion (PCT/ISA/237) issued in PCT Application No. PCT/JP2018/009477 dated Apr. 24, 2018 (five (5) pages).
Chinese-language Office Action issued in Chinese Application No. 201880013858.8 dated Apr. 28, 2020 with English translation (18 pages).
Extended European Search Report issued in European Application No. 18780377.0 dated Nov. 23, 2020 (nine (9) pages).
Japanese language Office Action issued in Japanese Application No. 2019-511111 dated Feb. 9, 2021 with English translation (12 pages).

* cited by examiner

INKJET RECORDING DEVICE

TECHNICAL FIELD

The present invention relates to an inkjet recording device, particularly, to a twin-nozzle type inkjet recording device.

BACKGROUND ART

JP 2005-515918 W (Patent Document 1) discloses the background art relating to the technical field. Patent Document 1 discloses a twin-nozzle print head for a continuous inkjet deflection printer, which includes an ink droplet generator assembly with two inkjet discharge nozzles, each of which has an axial line; a charging electrode; a deflection electrode that deflects charged droplets; and a single ink droplet recovery gutter for both nozzles, in which the axial lines of the nozzles converge to a point which is located in the vicinity of a single inlet of the single recovery gutter or upstream of the gutter, and on an axial line of the single inlet.

CITATION LIST

Patent Document

Patent Document 1: JP 2005-515918 W

SUMMARY OF THE INVENTION

Problems to be Solved by the Invention

In an inkjet recording device with the print head structure of Patent Document 1, two inkjet discharge nozzles are disposed such that axial lines of two inkjet discharge nozzles converge to one point. Therefore, regardless of whether the print height of each of print results printed by two inkjet discharge nozzles in a deflection direction is large or small, the inkjet recording device is capable of printing print contents while not causing an increase in space between the prints formed by two inkjet discharge nozzles.

In an inkjet recording device, generally, a print result printed by an inkjet discharge nozzle is inclined in principle due to a printed object being moved at a transport speed, and due to the travelling distances of print particles hitting the printed object differing dependent on the distance between the inkjet discharge nozzle and the printed object, for example, even when printing one vertical row of print content. However, when the inkjet recording device with the print head structure of Patent Document 1 performs printing, prints formed by two inkjet discharge nozzles are inclined opposite to each other, thereby causing characters to be bent or oppositely bent, and a difference in the inclines of the characters. For this reason, when the print head is rotated to correct the incline of a print result printed by one inkjet discharge nozzle, the rotation direction of the print head becomes opposite to a direction in which a print result printed by the other inkjet discharge nozzle is desirably corrected, and the characters are further inclined. In other words, there is a problem, such as not being capable of correcting the inclines of the print results even though rotating the print head.

In order to perform printing while not causing an increase in space between prints formed by two nozzles, for example, conceivably, the printing of one nozzle disposed downstream is configured as two rows of printing, such as printing a print in an upper row and a blank in a lower row, in order to avoid an increase in space between prints formed by two nozzles; however, it is necessary to actually print two rows of print content, and it is necessary to decrease the transport speed of a printed object to secure print quality.

An object of the present invention is to provide an inkjet recording device having a function for being capable of correcting the incline of characters of each of print results printed by two nozzles, and for being capable of adjusting a clearance between the prints formed by two nozzles, while not decreasing the transport speed of a printed object.

Solutions to Problems

In an example of the present invention made in light of the background art and the problem, there is provided an inkjet recording device which has two sub-print heads, each of which includes a nozzle that forms ink particles by applying vibration to ink being ejected under pressure, a charging electrode for charging the ink particles, a deflection electrode for deflecting the charged ink particles, and a gutter for recovering ink particles not used in printing, in which two nozzles are disposed in a deflection direction of the ink particles, and which performs printing on a printed object while moving the printed object relative to the ink particles in a direction substantially perpendicular to the deflection direction of the ink particles, the inkjet recording device having a function for reducing a clearance between print results, printed by the two nozzles, by controlling a voltage applied to the charging electrode and a voltage applied to the deflection electrode.

Effects of the Invention

According to the present invention, it is possible to provide an inkjet recording device capable of adjusting a clearance between prints formed by two nozzles, and capable of printing a print content at a high speed.

MODE FOR CARRYING OUT THE INVENTION

Hereinbelow, examples of the present invention will be described with reference to the drawings.

Example 1

In an example, a function for reducing a clearance between print results printed by two nozzles will be described.

Figure 1:
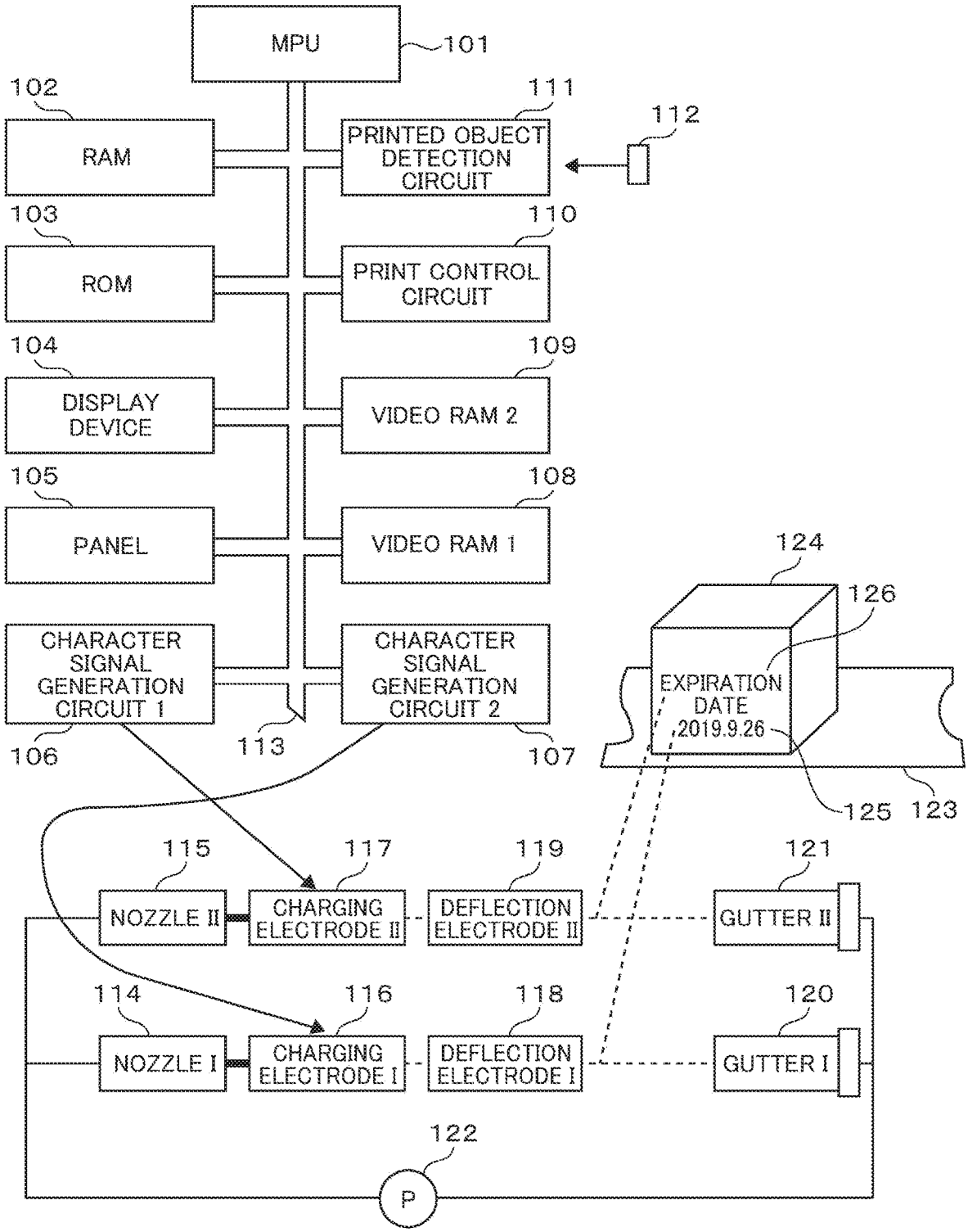
FIG. 1 is a configuration diagram of an inkjet recording device of Example 1.

FIG. 1 is a configuration diagram of an inkjet recording device of the example. In FIG. 1, 101 denotes a microprocessing unit (MPU) that controls the entirety of the inkjet recording device, 102 denotes a random access memory (RAM) that temporarily stores data in the inkjet recording device, 103 denotes a read-only memory (ROM) that stores software and data for calculating a write position, 104 denotes a display device that displays data, print contents, and the like which are input, 105 denotes a panel through which character information to be printed or the like is input, 110 denotes a print control circuit that controls the printing of the inkjet recording device in overall, 111 denotes a printed object detection circuit, 112 denotes a sensor that detects a printed object, 108 denotes a video RAM 1 that stores video data which is a charging voltage to charge ink particles from a nozzle I (114) corresponding to character data, 109 denotes a video RAM 2 that stores video data which is a charging voltage to charge ink particles from a nozzle II (115) corresponding to character data, 106 denotes a character signal generation circuit 1 that converts the video data, stored in the video RAM 1 (108), into a character signal, 107 denotes a character signal generation circuit 2 that converts the video data, stored in the video RAM 2 (109), into a character signal, 113 denotes a bus line for transmitting data and the like, 114 denotes a first nozzle I that forms ink particles by applying vibration to ink being ejected under pressure, and 115 denotes a second nozzle II that forms ink particles.

Figure 2:
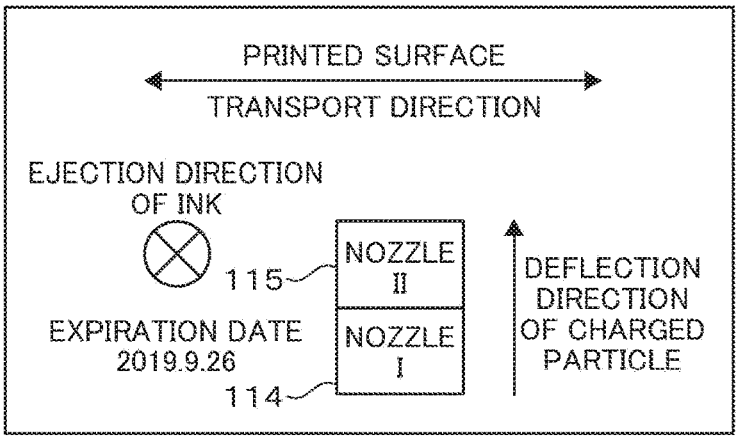
FIG. 2 is a diagram describing the disposition of two nozzles in Example 1.

As illustrated in FIG. 2, the example relates primarily to the inkjet recording device that performs printing using a print head to which the nozzle I (114) and the nozzle II (115) are attached in a row in a deflection direction (perpendicular to a transport direction of a printed object) of charged particles on a printed surface. That is, the nozzle I (114) is disposed upstream in the deflection direction, and the nozzle II (115) is disposed downstream in the deflection direction. The inkjet recording device has a print head structure in which print results printed by two nozzles are inclined in the same direction due to a printed object being moved.

In FIG. 1, 116 denotes a charging electrode I that charges ink particles ejected from the nozzle I (114), 117 denotes a charging electrode II that charges ink particles ejected from the nozzle II (115), 118 denotes a deflection electrode I that deflects the ink particles ejected from the nozzle I (114) and charged, 119 denotes a deflection electrode II that deflects the ink particles ejected from the nozzle II (115) and charged, 120 denotes a gutter I that recovers ink injected from the nozzle I (114) but not used in printing, 121 denotes a gutter II that recovers ink injected from the nozzle II (115) but not used in printing, 122 denotes a pump that supplies the ink, recovered by the gutters I and II, back to the nozzles I and II, 123 denotes a conveyor that transports a printed object, 124 denotes the printed object which is a target for printing, 125 denotes a print result printed on the printed object by the nozzle I (114), and 126 denotes a print result printed on the printed object by the nozzle II (115). If a sub-print head is defined as being one set of a nozzle, a charging electrode, a deflection electrode, and a gutter, the example relates primarily to a print head with two sub-print heads.

Subsequently, a series of operations from when a print content is input until printing is completed will be described in outline. Firstly, if print content data is input via the panel 105, the MPU 101 is capable of configuring a print content by causing a program, stored in the ROM 103, to compile video data to charge ink particles in response to print information, and by storing the video data in the video RAMS 1 and 2 via the bus line 113.

The ROM 103 has a program by which when print content data is input to the panel 105, it is possible to change a relative ratio between video data (relative ratio between charging voltage values) for being stored in the video RAM 1 (108) and the video RAM 2 (109), and it is possible to change a relative ratio between deflection voltages applied to the deflection electrode I (118) and the deflection electrode II (119). It is possible to increase or decrease the size of a character of each of the print result 125 of the nozzle I (114) and the print result 126 of the nozzle II (115) by the program.

Figure 3:
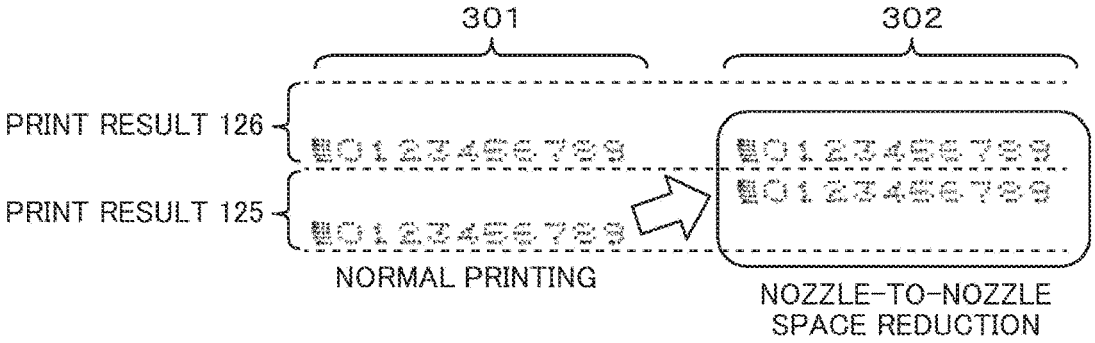
FIG. 3 is a diagram illustrating a nozzle-to-nozzle reduction function in Example 1.

In the example, as a configuration item selected when print content data is input to the panel 105, there is provided an item to select a nozzle-to-nozzle space reduction function, which is a function for reducing a space between the print result 125 of the nozzle I (114) and the print result 126 of the nozzle II (115). For example, the panel 105 displays a "nozzle-to-nozzle space reduction" button, and if the "nozzle-to-nozzle space reduction" button is selected, the nozzle-to-nozzle space reduction function is selected. If the nozzle-to-nozzle space reduction function is selected, the ROM 103 changes the charging voltage value of the video data for being stored in the video RAM 1 (108) to a large charging voltage value, and changes the deflection voltage, applied to the deflection electrode I (118), to a large deflection voltage. Therefore, in FIG. 3, if using the nozzle-to-nozzle space reduction function as indicated by 302, it is possible to move the print position of the print result 125 upward and reduce the space between the print result 125 and the print result 126, and thus to solve the problem that, in normal printing indicated by 301, there occurs a reduction in the print result 125, and the space between the print result 125 and the print result 126 becomes empty.

Figure 4:
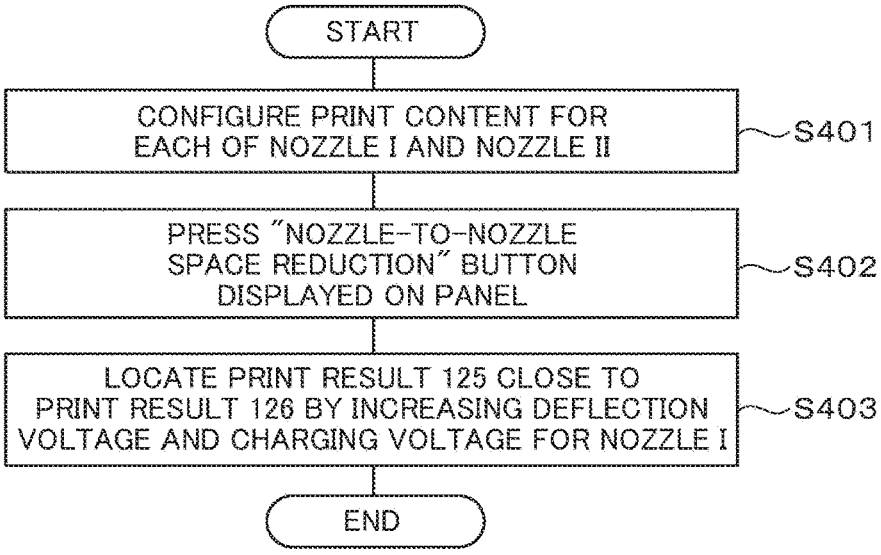
FIG. 4 is a configuration flow of the nozzle-to-nozzle space reduction function in Example 1.

FIG. 4 illustrates a configuration flow of the nozzle-to-nozzle space reduction function in the example. In FIG. 4, in Step S401, a print content is configured for each of the nozzle I and the nozzle II. In Step S402, the "nozzle-to-nozzle space reduction" button displayed on the panel is pressed, and thus the nozzle-to-nozzle space reduction function is selected. In Step S403, the deflection voltage and the charging voltage for the nozzle I are increased, and thus the print result 125 of the nozzle I is located close to the print result 126 of the nozzle II.

As described above, in the example, the print head has a structure in which print results printed by two nozzles are inclined in the same direction, and thus it is possible to rotate the print head to correct the incline of the print results. In addition, because the nozzle-to-nozzle space reduction function is provided, it is possible to provide the inkjet recording device capable of printing a print content at a high speed, by which a clearance between prints formed by two nozzles is reduced.

Example 2

In a case which will be described in an example, one print content is printed by two nozzles.

Figure 5:
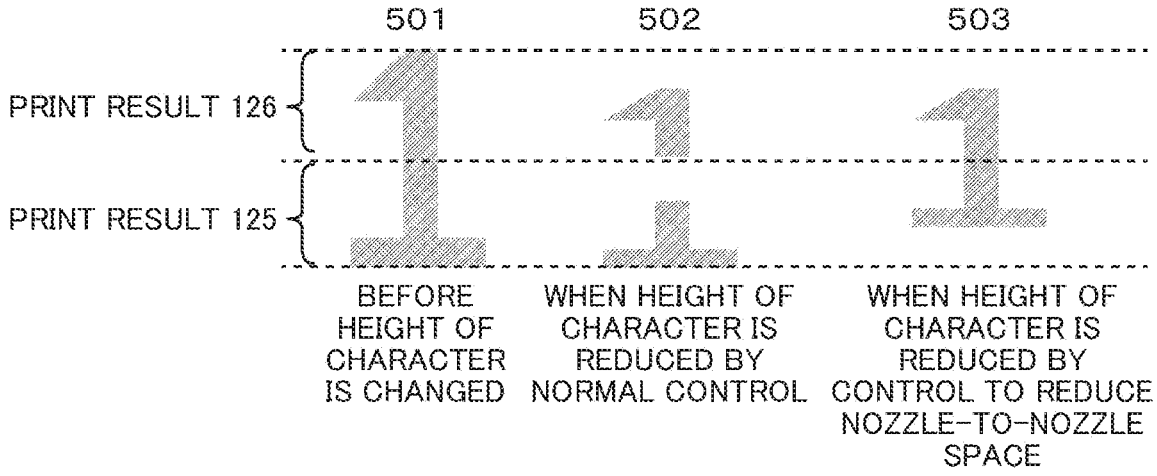
FIG. 5 is a diagram describing a function for adjusting the size of a character of a print combined by two nozzles in Example 2.

FIG. 5 is a diagram describing a function for adjusting the size of a character of a print combined by two nozzles in the example. As illustrated in FIG. 5, when one character is printed by a combination of the print result 125 of the nozzle I (114) and the print result 126 of the nozzle II (115), 501 indicates a state where the height of the character has not yet been changed. When one print content is printed by normal control of two nozzles, if the size of the character is adjusted small, the space between the print result 125 and the print result 126 becomes empty as indicated by 502. If controlling the nozzle-to-nozzle space reduction function described in Example 1, it is possible to adjust the size of each of the print result 125 and the print result 126 in a state where the space between the print result 125 and the print result 126 is fixed. As indicated by 503, it is possible to realize a print in which the size of a print result 501 in a deflection direction of charged particles is reduced.

Example 3

In a case which will be described in an example, the number of vertical dots per row differs between print contents printed by two nozzles in Example 1.

Figure 6:
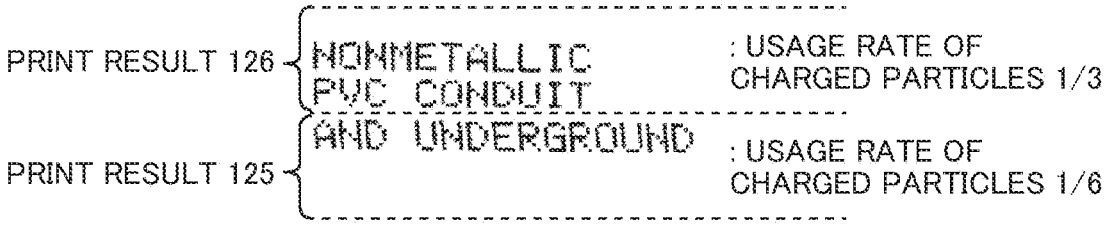
FIG. 6 is an explanatory diagram of a case where the number of vertical dots per row differs between two nozzles in Example 3.

FIG. 6 is an explanatory diagram of a case where the number of vertical dots per row differs between two nozzles in the example. In FIG. 6, if the print result 125 of the nozzle I (114) is a print content in a first row, and the print result 126 of the nozzle II (115) is a print content in a second row, when the nozzle I (114) has completed printing, because the nozzle II (115) has the print content two times that of the nozzle I (114), the nozzle II (115) is capable of printing only half the print content. That is, inversely, it can be considered that the nozzle I (114) has an interval two times that of the nozzle II (115) until the printing of the nozzle II (115) is completed. Because the usage rate of charged particles of the nozzle I (114) can be reduced to one-half of that of the nozzle II (115), and after being thinned out, a print formed by charged particles can be used, it is possible to reduce effects caused by Coulomb repulsion between travelling particles, and to realize a high quality of the print result 125 of the nozzle I (114). That is, if the number of print dots per row differs between two nozzles, it is possible to improve print quality, to the extent of difference in the number of dots per row between one nozzle ejecting a small number of dots per row and the other nozzle ejecting a large number of dots per row, by a control function for enlarging distances between travelling particles of dots used in one row of printing.

Example 4

In an example, a function for enlarging a clearance between print results printed by two nozzles will be described.

Figure 7:
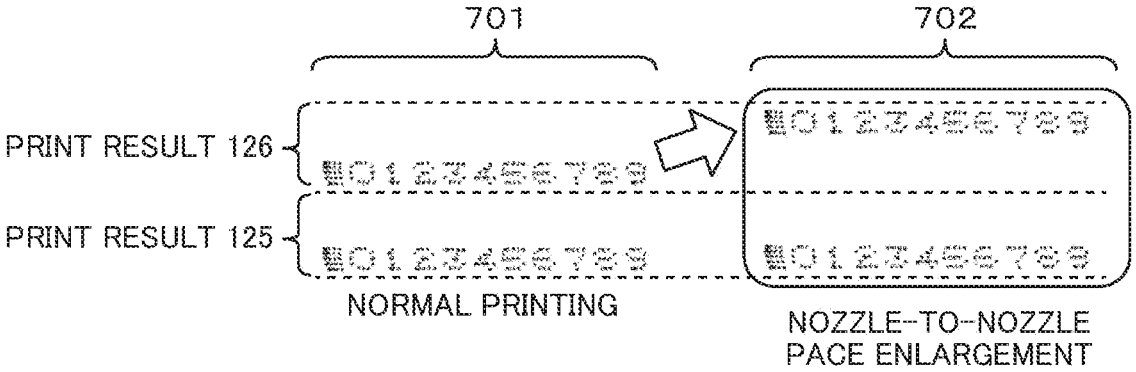
FIG. 7 is a diagram illustrating a nozzle-to-nozzle enlargement function in Example 4.

FIG. 7 is a diagram illustrating a nozzle-to-nozzle enlargement function in the example. The nozzle-to-nozzle enlargement function is applied to a case where contents are desirably printed apart from each other by two nozzles, and can be applied, for example, to when there is a gap between printed objects and contents are desirably printed by two nozzles such that the printing of the contents in the gap is avoided, or to when contents are printed on two separate printed objects by two nozzles, respectively. The example has the same configuration diagram of the inkjet recording device and the same disposition of two nozzles as those in Example 1, and thus the configuration diagram and the disposition will not be described.

In the example, as a configuration item selected when print content data is input to the panel 105, there is provided an item to select the nozzle-to-nozzle space enlargement function, which is a function for enlarging the space between the print result 125 of the nozzle I (114) and the print result 126 of the nozzle II (115). For example, the panel 105 displays a "nozzle-to-nozzle space enlargement" button, and if the "nozzle-to-nozzle space enlargement" button is selected, the nozzle-to-nozzle space enlargement function is selected. If the nozzle-to-nozzle space enlargement function is selected, the ROM 103 changes the charging voltage value of the video data for being stored in the video RAM 2 (109) to a large charging voltage value, and changes the deflection voltage, applied to the deflection electrode II (119), to a large deflection voltage. Therefore, as illustrated in FIG. 7, if using the nozzle-to-nozzle space enlargement function, as indicated by 702, to enlarge the space between the print result 125 and the print result 126 when each of the print result 125 and the print result 126 is reduced in normal printing indicated by 701, it is possible to move the print position of the print result 126 upward, and thus to enlarge the space between the print result 125 and the print result 126.

Figure 8:
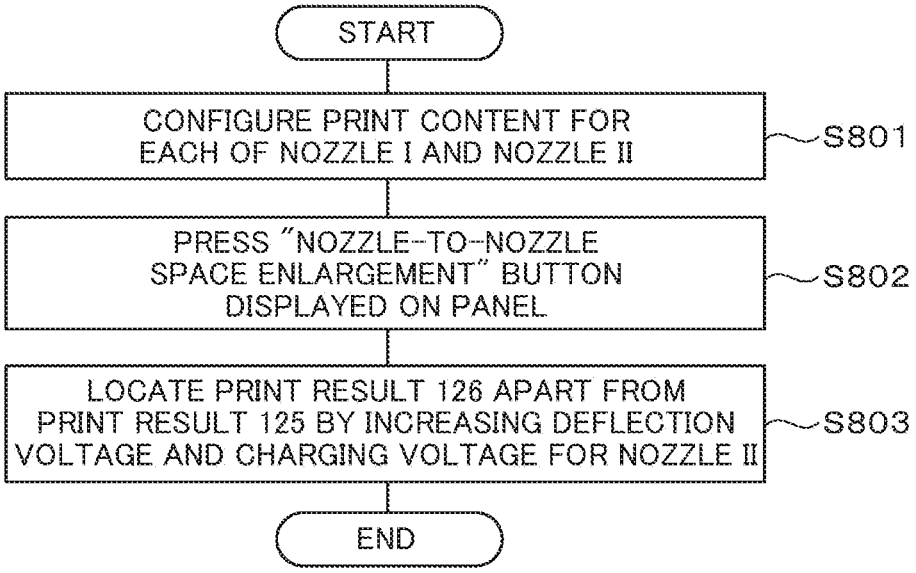
FIG. 8 is a configuration flow of the nozzle-to-nozzle space enlargement function in Example 4.

FIG. 8 illustrates a configuration flow of the nozzle-to-nozzle space enlargement function in the example. In FIG. 8, in Step S801, a print content is configured for each of the nozzle I and the nozzle II. In Step S802, the "nozzle-to-nozzle space enlargement" button displayed on the panel is pressed, and thus the nozzle-to-nozzle space enlargement function is selected. In Step S803, the deflection voltage and the charging voltage for the nozzle II are increased, and thus the print result 126 of the nozzle II is located apart from the print result 125 of the nozzle I.

As described above, in the example, the nozzle-to-nozzle space enlargement function is provided, and thus it is possible to provide the inkjet recording device capable of printing a print content at a high speed, by which a clearance between prints formed by two nozzles is enlarged.

Example 5

In a case which will be described in an example, the number of vertical dots per row differs between print contents printed by two nozzles in Example 4.

Figure 9:
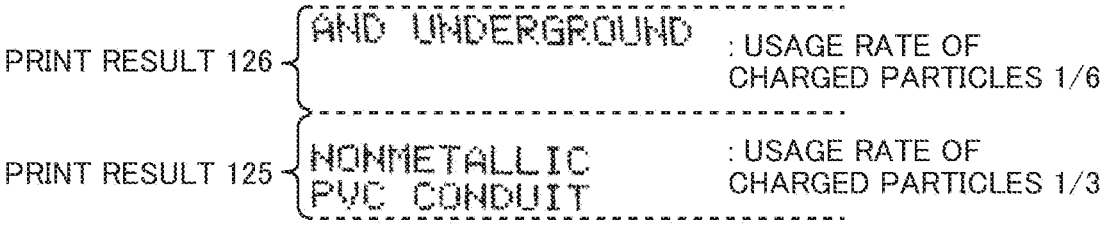
FIG. 9 is an explanatory diagram of a case where the number of vertical dots per row differs between two nozzles in Example 5.

FIG. 9 is an explanatory diagram of a case where the number of vertical dots per row differs between two nozzles in the example. In FIG. 9, if the print result 125 of the nozzle I (114) is a print content in a second row, and the print result 126 of the nozzle II (115) is a print content in a first row, when the nozzle II (115) has completed printing, because the nozzle I (114) has the print content two times that of the nozzle II (115), the nozzle I (114) is capable of printing only half the print content. That is, inversely, it can be considered that the nozzle II (115) has an interval two times that of the nozzle I (114) until the printing of the nozzle I (114) is completed. Because the usage rate of charged particles of the nozzle II (115) can be reduced to one-half of that of the nozzle I (114), and after being thinned out, a print formed by charged particles can be used, it is possible to reduce effects caused by Coulomb repulsion between particles, and to realize a high quality of the print result 126 of the nozzle II (115).

The examples have been described above; however, the present invention is not limited to the examples, and may include various modification examples. For example, part of the configuration of an example can be replaced into the configurations of other examples, and the configuration of an example can be added to the configurations of other examples. Other configurations can be added to, removed from, or replaced with part of the configuration of each example. For example, an inkjet recording device may have the functions of Examples 1 and 4, and both of the nozzle-to-nozzle space reduction function and the nozzle-to-nozzle space enlargement function. In this case, a process flow may be obtained by mixing together the flows of FIGS. 4 and 8. The panel may display the "nozzle-to-nozzle space reduction" button and the "nozzle-to-nozzle space enlargement" button, and when either button is pressed, the related function may be executed.

REFERENCE SIGNS LIST

105 Panel
106 Character signal generation circuit 1
107 Character signal generation circuit 2
108 Video RAM 1
109 Video RAM 2
114 Nozzle I
115 Nozzle II
116 Charging electrode I
117 Charging electrode II
118 Deflection electrode I
119 Deflection electrode II
120 Gutter I
121 Gutter II
124 Printed object
125 Print result printed on printed object by nozzle I (114)
126 Print result printed on printed object by nozzle II (115)

The invention claimed is:

1. An inkjet recording device which has two sub-print heads, each of which includes a nozzle that forms ink particles by applying vibration to ink being ejected under pressure, a charging electrode for charging the ink particles, a deflection electrode for deflecting the charged ink particles, and a gutter for recovering ink particles not used in printing, in which two nozzles are disposed in a deflection direction of the ink particles, and which performs printing on a printed object while moving the printed object relative to the ink particles in a direction substantially perpendicular to the deflection direction of the ink particles, wherein the inkjet recording device has a function for reducing a clearance between print results, printed by the two nozzles, by controlling a voltage applied to the charging electrode and a voltage applied to the deflection electrode, wherein one print content is printed by the two nozzles, and wherein a charging voltage of a first charging electrode, which charges ink particles formed by a first nozzle of the two nozzles, which is disposed upstream in the deflection direction of the ink particles, is changed to a large charging voltage, and a deflection voltage, which is applied to a first deflection electrode which deflects the ink particles charged by the first charging electrode, is changed to a large deflection voltage, and thus a size of the one print content can be adjusted in a state where a space between a print result printed by the first nozzle and a print result printed by a second nozzle is fixed.

2. The inkjet recording device according to claim 1, wherein the voltage applied to the charging electrode and the voltage applied to the deflection electrode are controlled to change the charging voltage of the first charging electrode, which charges ink particles formed by the first nozzle of the two nozzles, which is disposed upstream in the deflection direction of the ink particles, to the large charging voltage, and to change the deflection voltage, which is applied to the first deflection electrode which deflects the ink particles charged by the first charging electrode, to the large deflection voltage.

3. The inkjet recording device according to claim 1, wherein the inkjet recording device has a print head structure in which the print results printed by the two nozzles are inclined in the same direction due to the printed object being moved.

4. The inkjet recording device according to claim 1, wherein if the number of print dots per row differs between the two nozzles, print quality of one nozzle ejecting a small number of dots per row is improved, to the extent of difference in the number of dots per row between one nozzle and the other nozzle ejecting a large number of dots per row, by a control function for enlarging distances between travelling particles of dots used in one row of printing.

5. An inkjet recording device which has two sub-print heads, each of which includes a nozzle that forms ink particles by applying vibration to ink being ejected under pressure, a charging electrode for charging the ink particles, a deflection electrode for deflecting the charged ink particles, and a gutter for recovering ink particles not used in printing, in which two nozzles are disposed in a deflection direction of the ink particles, and which performs printing on a printed object while moving the printed object relative to the ink particles in a direction substantially perpendicular to the deflection direction of the ink particles, wherein the inkjet recording device has a function for enlarging a clearance between print results, printed by the two nozzles, by controlling a voltage applied to the charging electrode and a voltage applied to the deflection electrode, wherein one print content is printed by the two nozzles, and wherein a charging voltage of a first charging electrode, which charges ink particles formed by a first nozzle of the two nozzles, which is disposed upstream in the deflection direction of the ink particles, is changed to a large charging voltage, and a deflection voltage, which is applied to a first deflection electrode which deflects the ink particles charged by the first charging electrode, is changed to a large deflection voltage, and thus a size of the one print content can be adjusted in a state where a space between a print result printed by the first nozzle and a print result printed by a second nozzle is fixed.

6. The inkjet recording device according to claim 5, wherein the voltage applied to the charging electrode and the voltage applied to the deflection electrode are controlled to change the charging voltage of a second charging electrode, which charges ink particles formed by the second nozzle of the two nozzles, which is disposed downstream in the deflection direction of the ink particles, to the large charging voltage, and to change the deflection voltage, which is applied to a second deflection electrode which deflects the ink particles charged by the second charging electrode, to the large deflection voltage.

7. The inkjet recording device according to claim 5, wherein the inkjet recording device has a print head structure in which the print results printed by the two nozzles are inclined in the same direction due to the printed object being moved.

8. The inkjet recording device according to claim 5, wherein if the number of print dots per row differs between the two nozzles, print quality of one nozzle ejecting a small number of dots per row is improved, to the extent of difference in the number of dots per row between one nozzle and the other nozzle ejecting a large number of dots per row, by a control function for enlarging distances between travelling particles of dots used in one row of printing.

* * * * *